US005431106A

United States Patent [19]

Dunn et al.

[11] Patent Number: 5,431,106

[45] Date of Patent: Jul. 11, 1995

[54] RELEASE OF DAUGHTER MISSILES

[75] Inventors: Albert Dunn, Bangor; Richard S. Ranson, Holywood, both of Ireland

[73] Assignee: Shorts Missile Systems Limited, Belfast, Ireland

[21] Appl. No.: 754,935

[22] Filed: Jun. 5, 1985

[51] Int. Cl.[6] ..... F42B 12/58

[52] U.S. Cl. ..... 102/489; 102/357; 102/374; 102/377

[58] Field of Search ..... 102/293, 374, 377, 378, 102/340, 342, 351, 357, 489, 501, 505, 703

[56] References Cited

U.S. PATENT DOCUMENTS

| | | | |
|---|---|---|---|
| 3,295,444 | 1/1967 | Cushing et al. . | |
| 3,461,801 | 8/1969 | Vitale et al. | 102/489 |
| 3,771,455 | 11/1973 | Haas | 102/703 |
| 3,946,672 | 3/1976 | Adams et al. | 102/377 |
| 4,488,489 | 12/1984 | Schoffl | 102/489 |

FOREIGN PATENT DOCUMENTS

| | | | |
|---|---|---|---|
| 114901 | 8/1984 | European Pat. Off. . | |
| 2609391 | 9/1977 | Germany | 102/489 |
| 2920347 | 11/1980 | Germany . | |
| 985229 | 3/1965 | United Kingdom . | |
| 1135541 | 12/1968 | United Kingdom . | |
| 1165802 | 10/1969 | United Kingdom . | |
| 1181159 | 2/1970 | United Kingdom . | |
| 1406471 | 9/1975 | United Kingdom . | |
| 2091855 | 8/1982 | United Kingdom | 102/505 |

*Primary Examiner*—Harold J. Tudor
*Attorney, Agent, or Firm*—Cushman Darby & Cushman

[57] ABSTRACT

Daughter missiles 11 are catapulted forward from a mother missile 10 when a rocket motor 12 of the mother no longer accelerates the missiles. A catapult force generated at a piston head 43 by the pressure of gas from the rocket motor on rearward facing surfaces 26 of the daughters is large enough to shear pins 34 holding the daughters to the mother, but only when the forces of reaction of the daughters 11 on the piston 43, due to acceleration, have fallen off. Preferably the daughters are thrown outwardly at release, most preferably by axial spinning of the structure of the mother to which they are mounted.

9 Claims, 2 Drawing Sheets

RELEASE OF DAUGHTER MISSILES

FIELD OF THE INVENTION

This invention relates to a method of, and apparatus for, effecting the release of a plurality of daughter missiles from an elongate mother missile in flight of the mother missile, with substantially no loss of forward momentum of the daughter missiles.

BACKGROUND OF THE INVENTION

The present Applicants are currently seeking to provide a missile system in which aerial guided "daughter" missiles fly along a line of sight to a target and which are accelerated to flight speed by a rocket-propelled mother missile. The release of the daughter missiles from the mother missile is required to occur when the, or the final, rocket motor of the mother missile is all burnt. Any undue disturbance to the designed flight paths of the daughter missiles and loss of their forward momentum during their release is to be avoided. It is one object of the present invention to meet these requirements.

SUMMARY OF THE INVENTION

According to one aspect of the present invention there is provided a method of effecting the in-flight discharge of a daughter missile forwardly from a rocket-propelled mother missile after a period of acceleration of the daughter missile brought about by the burning of the rocket motor of the mother missile, characterised by the steps of i) establishing before the end of said period of acceleration a catapult force for accomplishing said forward discharge and ii) utilising the force of reaction to the acceleration of said daughter missile to oppose the catapult force, whereby the catapult force is insufficient to bring about the forward discharge during the said period of acceleration yet sufficient as soon as the period of acceleration ends.

According to a second aspect of the present invention there is provided an aerial guided missile comprising a mother missile and at least one daughter missile carried on the mother missile, the mother missile having a rocket motor for accelerating the missile for a period along a flight path towards a target, and the daughter missile being mounted for in-flight forward discharge from the mother missile at the end of the period of acceleration, characterised by means to impose on the daughter missile during the period of acceleration a catapult force sufficient to accomplish said forward discharge in the absence of the acceleration to which the missile is subject during the said period of acceleration, yet which is insufficient while it is opposed by the force of reaction of the daughter missile on the mother missile, present during said period of acceleration.

It is convenient to rely upon the pressure of the propellent gas of the rocket motor (normally a second stage motor) to provide the catapult force. This can be delivered to the or each daughter missile by a piston arranged to contact the daughters and to be urged forwardly by the gas pressure. If desired, a shear pin can be used to prevent premature forward movement of the piston. Premature forward discharge can be prevented by pinning the or each daughter missile to the mother missile with a fastener, the pinning force of which is arranged to be overcome by the catapult force at the moment of release of the or each daughter missile. One way of achieving the pinning is to use a shear pin which is broken at the moment of release.

A number of daughter missiles can be mounted alongside each other on a sleeve (otherwise called a shoe) slidable on the axis of the mother missile, the daughter missiles being arranged evenly around the sleeve axis. The sleeve may be biased to a storage disposition at the rear of its range of movement. Such biasing is effective to absorb handling shocks prior to release of the daughter missiles. The fastener by which each daughter missile is fastened by a pinning force to the sleeve has a grip adapted to be broken by the shear forces imposed on it by the catapult force when the mother missile is no longer accelerating. Preferably, each fastener is a single shear pin level (along the length of the missile) with the centre of gravity of the daughter missile.

Preferably, the daughter missiles have a radially outward acceleration at their moment of release. This can be given them by arranging for the daughter missile structure to be spinning at the moment of release and/or by accelerating the daughter missiles outwardly (as by ramps) in a forward movement on the mother missile from a flight disposition to a release disposition.

For a better understanding of the present invention, and to show more clearly how the same may be carried into effect, reference will now be made to the accompanying drawings.

DETAILED DESCRIPTION

Figure 1:
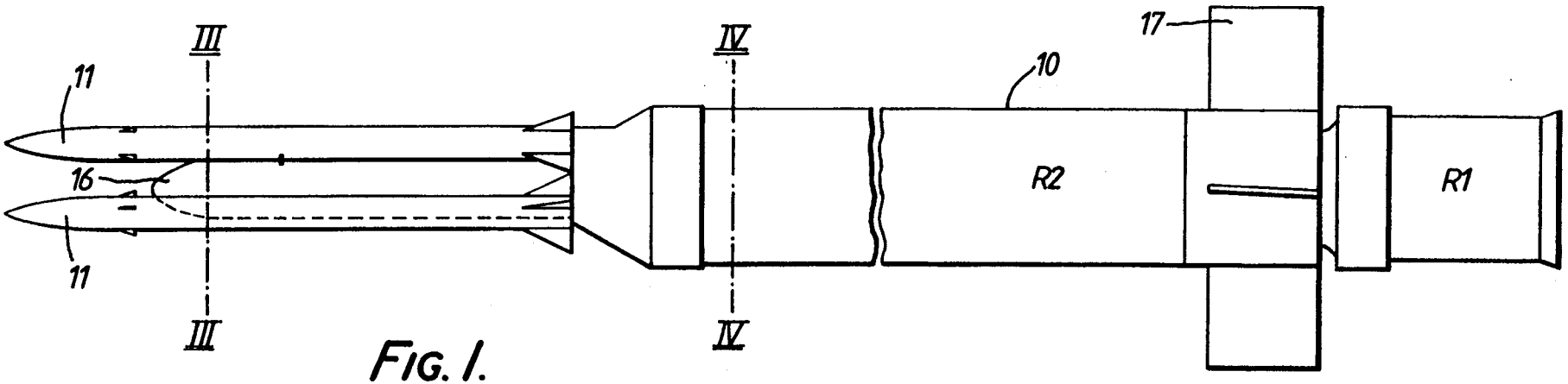
FIG. 1 is a side elevation of a preferred embodiment of aerial guided missile in accordance with the invention.

The missile comprises a mother missile 10 and three daughter missiles 11 carried by it. The mother missile 10 has a first rocket motor R1 and a second motor R2 which fire in sequence, and flight control surfaces 17, which are also adapted to impart a spin to the mother missile during its flight. At the front of the propellent material 12 of the second stage motor R2 is a light alloy motor head piece 13 held to the casing 22 of the motor R2 by a threaded collar 23.

The head piece carries a hollow, daughter missile abutment and fairing structure 24 which,has three forward-facing abutment pads 25 which abut the rear faces 26 of the daughter missiles 11.

An axial spigot part 14 on the head piece 13 carries a support cylinder 15 which extends as far as a pointed nose 16. The spigot 14 bounds a pressure reservoir chamber A, closed by the cylinder 15 and nose 16. (In an alternative embodiment, the reservoir is closed not by the nose 16, but by a bulkhead across the hollow cylinder 15. This allows telemetry equipment to be installed in the cylinder, between the bulkhead and the nose.) When the second stage motor R2 is ignited, the chamber A becomes filled with compressed gases from the propellent material 12 by passage of these gases through a non-return valve 18 in the head piece 13. The structure of the valve 18 is not shown, but it is of the "pastille" type.

Figure 2:
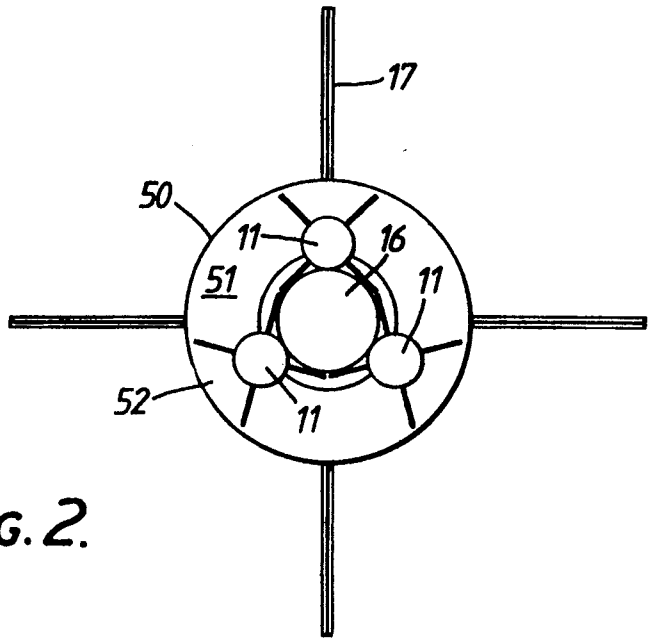
FIG. 2 is a transverse section along the line III—III in FIG. 1.

The cylinder 15 has on its cylindrical surface an annular recess 20, on which is slidable axially, but not rotatably, a sleeve 21. Three daughter missiles 11 are carried on the sleeve 21, each being secured to it by a shear pin fastener 34. The missiles 11 are disposed at angles of 120° to each other around the circumference of the sleeve 21, as shown in FIG. 2. A helical spring biasing means 31 is housed in the space between the cylinder 15 and the sleeve 21 between the end surface 23 of the recess 20 and a forward facing abutment surface 32 of the sleeve 21.

FIG. 2 shows a protective outer skin 50 and restraining blocks 51 and 52 of expanded polystyrene or other extremely lightweight material, which skin and blocks are caused to fall away from the daughter missiles 11 at some point before the second motor stage R2 becomes all-burnt but which, up to that point in the flight of the missile, serve to protect the daughter missiles from accidental damage and, during the early part of the flight of the missile, afford aerodynamic streamlining of the missile as a whole. Present indications are that such streamlining is not essential, so the skin and blocks could be dispensed with.

Figure 3:
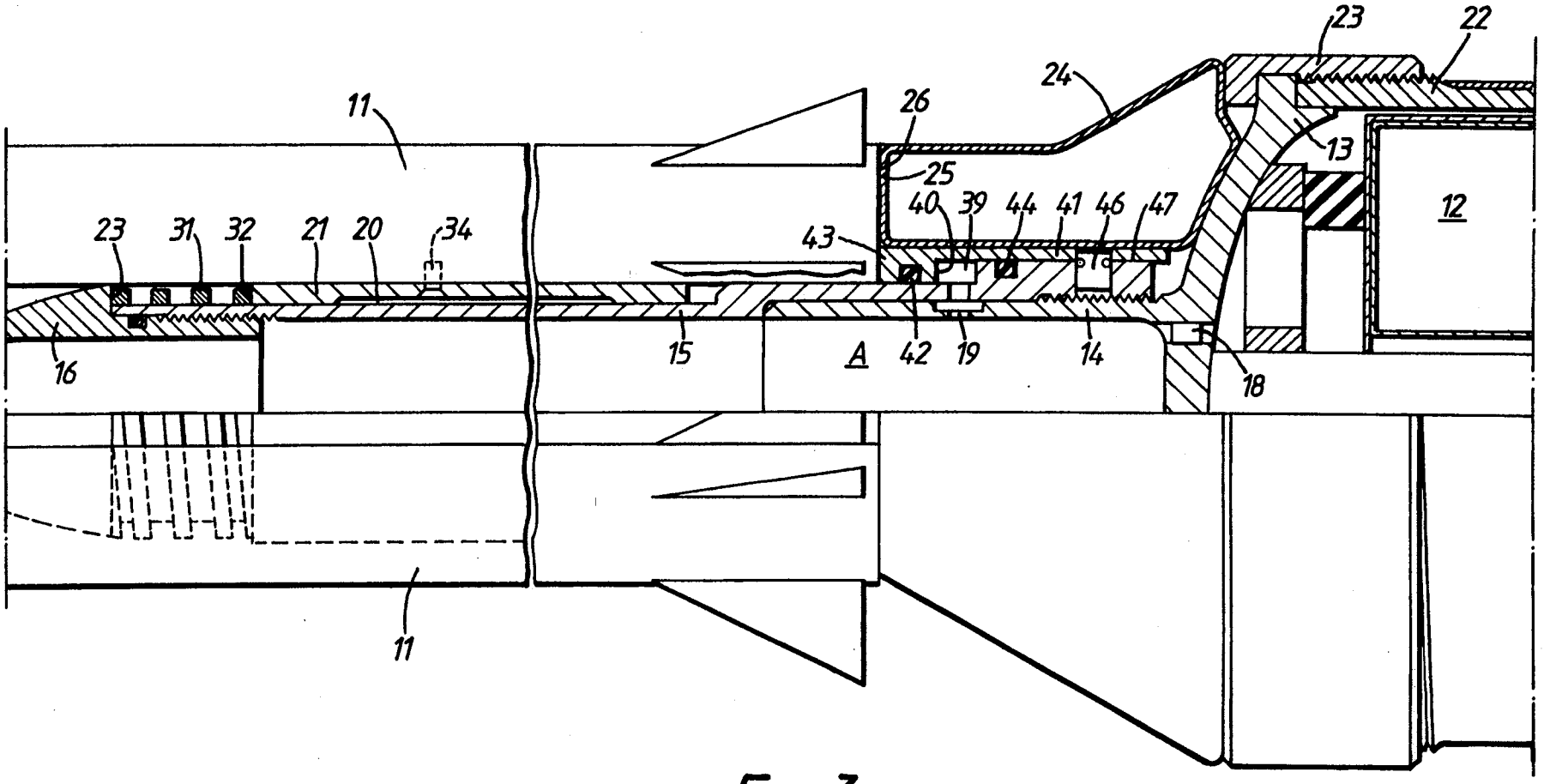
FIG. 3 is a longitudinal section of the part of the missile of FIG. 1 between lines III—III and IV—IV in FIG. 1, drawn to a larger scale to show more detail.

Referring now to FIG. 3, a plurality of apertures 19 through the support cylinder 15 and the spigot 14 permit passage of the propellent gases to a gas pressure chamber 39 bounded by a working annulus 40 of a piston 41 and the cylinder 15. A first O-ring 42 on the head end 43 of the piston and a second O-ring 44 on the external surface 47 of the cylinder 15 maintain the working space 39 gas-tight. The head end 43 of the piston is in contact with the rearward-facing surface 26 of the daughter missile 11 and a shear pin restraining means 46 resists relative movement of the piston on the annular external surface 47. Latest indications are that this shear pin 46 in unnecessary.

After launch of the mother missile, compressed propellent gases enter the working space 39 to generate a catapult force F on the piston 41, but the combination of inter alia i) the shear resistance of the shear pin 46, ii) the reaction R of the three daughter missiles, the sleeve and the piston 41, to the thrust of the rocket motor 12 on the head end 43 of the piston 41 and iii) the biasing force B of the spring 31, is effective to prevent the gas pressure from driving the daughter missiles forwardly relative to the support cylinder 15, but only for as long as the rocket motor 12 is delivering full thrust, i.e. generating acceleration of the daughter missile structure of daughter missiles 11, sleeve 21 and piston 41, and the reaction force R.

Release of the daughter missiles is required at the time of maximum velocity of the mother missile, at the moment when the second (and last) stage of the motor is all-burnt. When the thrust from the motor R2 falls off, there is a consequent decline in the force of reaction R on the head end 43 of the piston 41 (although drag forces on the daughter missiles will provide some residual pressure on the piston). The catapult force F on the piston, arising from the accumulated pressure of gas in the working space 39, is now high enough for the piston to shear the shear pin 46 and drive the piston forward, in turn driving forward the assembly of the sleeve 21 and three daughter missiles 11. This forward movement compresses the helical spring 31 up to the point when the turns of the spring abut each other, no substantial further compression occurs and there is rapid deceleration of the sleeve 21 on the cylinder 15.

This rapid deceleration of the sleeve 21, and continuing pressure of the head 43 of the piston on the daughter missiles 11, brings about shearing of the shear pins 34, thereby severing the connection between the daughter missiles and the sleeve 21. The forward movement of the daughter missiles which takes place between shearing of the pin 46 and the pins 34 can therefore be seen as a forward movement from a flight disposition to a launch disposition.

In embodiments which do not include a shear pin 46, the catapult force F is resisted by the pinning force P, up to the breaking stress of the shear pin 34, the reaction R of the three daughter missiles to acceleration of the mother missile, and any drag forces acting on the daughter missiles. The mass of the daughters is large relative to that of the sleeve 21.

In such embodiments, the forward movement to the launch disposition, and compression of the spring 31, is considered to occur during the phase of acceleration of the mother missile. At the end of the period of acceleration there is no further forward movement of the sleeve 21, but the decline in the reaction force R results in shearing of the pins 34 and forward discharge of the daughters 11.

The mother missile spins during burning of the motor 12, and the spinning motion endows the daughter missiles with a tendency to accelerate outwardly away from the longitudinal axis of the mother missile at the moment of fracture of the shear pins 34. Optimum release is achieved when the shear pins 34 are located level with the centre of gravity of the daughter missiles along their length.

The sleeve 21 can be replaced by a set of three cradles, one for each daughter missile, and arranged around the support cylinder 11. The cradles can be supported in a way which allows limited radially outward acceleration, e.g. up ramps, during the forward movement to the launch disposition, for endowing the daughter missiles with an acceleration radially outwardly which supplements the acceleration due to spinning or provides acceleration in a case where the mother missile is not spinning.

If desired, the sleeve 21 and shear pins 34 could be avoided by providing each of the daughters with, for example, a front pin and a rear pin which slide in a respective slot in the support cylinder 15, each slot being open at a forward end thereof to allow the pins to move radially outwardly when the daughter reaches the launch disposition.

We claim:

1. An aerial guided missile comprising a mother missile, a plurality of daughter missiles, and a daughter missile launch assembly carried by the mother missile for launching the daughter missiles from the mother missile during flight of the mother missile, the daughter missile launch assembly comprising a launch sleeve mounted on the mother missile for axial displacement thereon, attachment means which releasably attaches each daughter missile to the sleeve and which is breakable for release of the daughter missile by a predetermined axial thrust of the daughter missile with respect to the sleeve, the launch assembly being displaceable between a pre-launch disposition in which it is held during a period of acceleration of the mother missile and in which each daughter missile bears against first abutment means on the mother missile and a launch disposition which it takes up at the end of the period of acceleration of the mother missile and at which it is arrested by second abutment means on the mother missile so that forward axial thrust of the daughter missile is applied to the attachment means to effect breaking thereof and the release of the daughter missile, thrust generating means for generating a thrust for application to the assembly to move the assembly from the pre-launch disposition to the launch disposition, the thrust being sufficient to move the assembly to the launch disposition and to effect release of the daughter missile in the absence of acceleration of the mother missile to which the mother missile is subject during the period of acceleration yet being insufficient while it is opposed by reaction of the assembly present during the period of acceleration.

2. A missile as claimed in claim 1 characterised in that the thrust generating means comprises a rearwardly facing surface of a piston and means to deliver to a gas pressure chamber bounded by said surface compressed gas deriving from a rocket motor of the mother missile.

3. A missile as claimed in claim 2 characterised in that the attachment means comprises a fastener having a grip on the daughter missile which is adapted to be broken in shear by the forward thrust of the daughter missile.

4. A missile as claim 3 characterised in that the said fastener comprises a shear pin.

5. A missile as claimed in claim 2 characterised by a non-return valve for preventing return flow of gas from the gas pressure chamber to the rocket motor.

6. A missile as claimed in claim 2 wherein the piston has a forwardly facing surface which bears directly on each daughter missile.

7. A missile as claimed in claim 1 characterised by said daughter missiles being regularly spaced around the sleeve.

8. A missile as claimed in claim 7 characterised in that the sleeve is slidable on a spigot of the mother missile which projects forwardly on the longitudinal axis of the mother missile.

9. A missile as claimed in claim 8 characterised by a biasing means which generates a biasing force which urges the sleeve rearwardly, the thrust of the thrust generating means being sufficient in the absence of said acceleration to overcome the biasing force and any drag on the daughter missiles to effect their release.

* * * * *